US005659170A

United States Patent [19]

Da Silveira et al.

[11] Patent Number: 5,659,170

[45] Date of Patent: Aug. 19, 1997

[54] ION SOURCE FOR COMPACT MASS SPECTROMETER AND METHOD OF MASS ANALYZING A SAMPLE

[75] Inventors: Enio Frota Da Silveira, College Station, Tex.; Kevin Bernard Ray, Ballwin, Mo.; Emile Alfred Schweikert, Bryan, Tex.; Melvin Andrew Park, Raleigh, N.C.

[73] Assignee: The Texas A&M University System, College Station, Tex.

[21] Appl. No.: 357,510

[22] Filed: Dec. 16, 1994

[51] Int. Cl.[6] ..... H01J 49/40

[52] U.S. Cl. ..... 250/287; 250/281; 250/282

[58] Field of Search ..... 250/287, 281, 250/282

[56] References Cited

U.S. PATENT DOCUMENTS

| | | | |
|---|---|---|---|
| 4,489,237 | 12/1984 | Litherland et al. | 250/282 |
| 5,168,158 | 12/1992 | McComas et al. | 250/287 |
| 5,233,189 | 8/1993 | Wollnik | 250/287 |
| 5,360,976 | 11/1994 | Young et al. | 250/287 |
| 5,463,220 | 10/1995 | Young et al. | 250/281 |

OTHER PUBLICATIONS

J. L. Wiza, "Microchannel Plate Detectors", *Nuclear Instruments and Methods,* vol. 162, 587–601, (1979).

E.A. Kurz, "Channel Electron Multipliers", *American Laboratory,* Mar. 1979.

R.A. Zubarev, et al., "Electron Avalanche Desorption: a New Soft–ionization Technique for Non–volatile and/or Thermally Labile Molecules", *Rapid Communications in Mass Spectrometry,* vol. 5.

R.A. Zubarev, et al., "Comparison of Mass Spectra Obtained Using $^{252}$Cf Plasma–desorption and Electron–avalanche–desorption Mass Spectrometry", *Rapid Communications in Mass Spectrometry,* vol. 5, 278–282 (1991).

B.L. Henke, et al., eds., "Proceedings of the Eighteenth Annual Conference on Applications of X–Ray Analysis Held Aug. 6–8, 1969", *Advances in X–Ray Analysis,* vol. 13, (1970).

C.D. McAfee, "Spontaneous Desorption: Field Assisted Ion Induced Desorption Mass Spectrometry", Office of Graduate Studies of Texas A&M University, (1990).

F. Jamet and G. Thomer, *Flash Radiography,* Elsevier Scientific Publishing Company, (1976).

L.S. Birks, et al., "Excitation of Characteristic X Rays by Protons, Electrons, and Primary X Rays", *Jounal of Applied Physics,* vol. 35, No. 9, (1964).

P. Engström, et al., "X–Ray Capillary Optics", Conference Proceedings, vol. 25, 2nd European Conference on Progress in X–ray Synchrotron Radiation Research, A. Balerna, et al. (Eds.), SIF, Bologna, (1990).

T. Nordmeyer and K. A. Prather, "Real–Time Measurement Capabilities Using Aerosol Time–of–Flight Mass Spectrometry", *Anl. Chem.* vol. 66, pp. 3540–3542 (1994).

(List continued on next page.)

*Primary Examiner*—Michael J. Tokar
*Assistant Examiner*—Kiet T. Nguyen
*Attorney, Agent, or Firm*—Baker & Botts, L.L.P.

[57] ABSTRACT

A mass spectrometer 20 includes an electron multiplier 30 for producing an electron avalanche 58 directed toward an ionization region 38. A sample 40 enters the ionization region 38 through a sample inlet 68. In the ionization region 38 the electron avalanche 58 collides with the sample 40 and produces ions 60. A start detector 56 detects the electron avalanche 58 and provides a start signal. The ions 60 exit the ionization region 38 and enter a flight region 26. The ions 60 flow through the flight region 26 and interact with a stop detector 42. The stop detector 42 generates a stop signal in response to being activated. A low pressure enclosure 22 encloses at least the electron multiplier 30 and the ionization region 38. The start and stop signals are supplied to an analysis system for determining the mass of the sample using time-of-flight mass spectrometry.

24 Claims, 11 Drawing Sheets

OTHER PUBLICATIONS

Von H. Wollnik, et al., "Flugzeit–Massenspektrometer mit gitterfeien lonenspiegein und Elektronenstoβ–Ionenquellen", *Annalen der Physik*, pp. 215–228 (1991).

Eva Axelsson and Leif Holmlid, "Time–of–Flight Mass Spectrometry with Rapid Field Reversal: High Transmission with Continuous Electron Impact Ionization", *International Journal of Mass Spectrometry and Ion Processes*, 59:231–246 (1984).

George J. Blanar and Robert J. Cotter, "Proceedings of the International Conference on Instrumentation for Time–of–Flight Mass Spectrometry", LeCroy Corporation, Chestnut Ridge, New York, Nov. 11–12, 1992.

C. A. Bailey, et al., "A miniature time of flight mass spectrometer", *Vacuum*, vol. 21, No. 10, pp. 461–464.

Leif Holmlid, "Operation and Mass Resolution of a Time–of–Flight Mass Spectrometer with Electron Impact Ionization and Rapid Field Reversal", *International Journal of Mass Spectrometry and Ion Processes*, 59:247–259 (1984).

C. C. Hayden, et al., "A molecular beam time–of–flight mass spectrometer using low–energy–electron impact ionization", *Rev. Sci. Instrum.*, vol. 61, No. 2, pp. 775–782, Feb. 1990.

J. E. Pollard and R. B. Cohen, "Molecular Beams", *Rev. Sci. Instrum.*, vol. 58, No. 1, pp. 32–37, Jan. 1987.

W. C. Wiley and I. H. McLaren, "Time–of–Flight Mass Spectrometer with Improved Resolution", *The Review of Scientific Instruments*, vol. 26, No. 12, pp. 1150–1157, Dec. 1955.

R. Grix, et al., "An Electron Impact Storage Ion Source for Time–of–Flight Mass Spectrometers", *International Journal of Mass Spectrometry and Ion Processes*, 93:323–330 (1989).

Robert J. Cotter, "Time–of–Flight Mass Spectrometry for the Structural Analysis of Biological Molecules", *Analytical Chemistry*, vol. 64, No. 21, pp. 1027–1038, Nov. 1, 1992.

FIG. 7
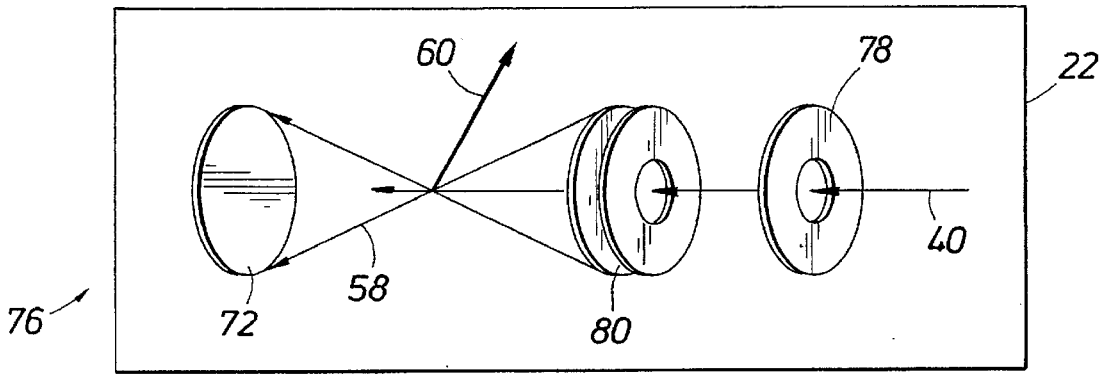
FIG. 9b
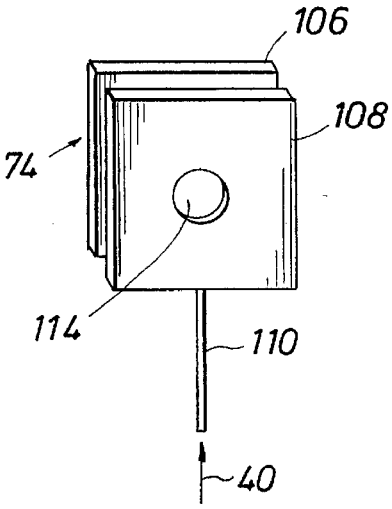
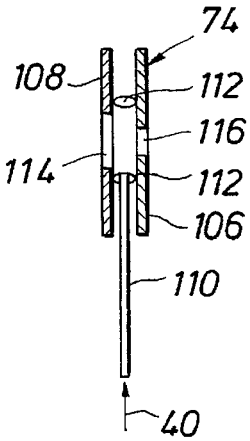
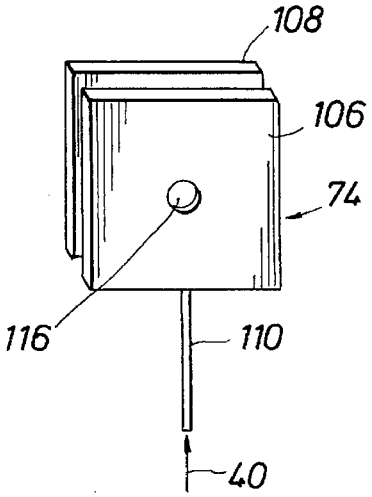
FIG. 9a
FIG. 9c
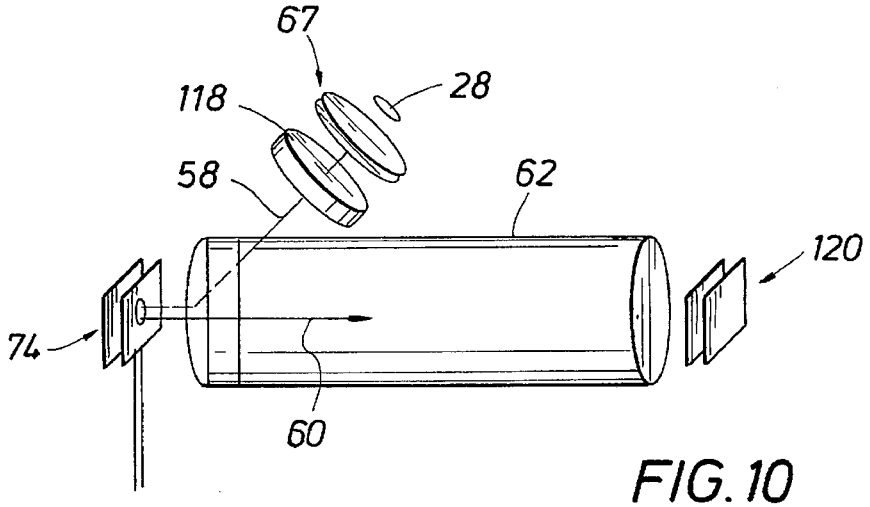
FIG. 10

ION SOURCE FOR COMPACT MASS SPECTROMETER AND METHOD OF MASS ANALYZING A SAMPLE

FIELD OF THE INVENTION

The present invention relates in general to the field of sample analysis, and more particularly to an ion source for compact mass spectrometer and method of mass analyzing a sample.

BACKGROUND OF THE INVENTION

Mass spectrometers are used in sample analysis. Mass spectrometry is the process whereby volatile, liquid and solid, organic and inorganic compounds are identified and quantified based on their molecular weight and characteristic fragmentation patterns. Mass spectrometers are often large and heavy. Effective operation of mass spectrometers requires, in most cases, strict control of temperature, humidity, and vibrations. These characteristics, among others, limit the use of mass spectrometers in the field.

Time-of-flight mass spectrometry is an intrinsically simpler approach to mass analysis than the approach used by mass analyzers based on ion cyclotron resonance or devices such as magnetic, and electrostatic sectors and quadrupoles. Scanning analyzers use a magnetic or electrostatic field to sort ions into their respective spectra for analysis by mass spectroscopy. The sorting is accomplished by varying the magnetic or electrical field strength. Hence, at any given time, only one mass may be detected. Time-of-flight spectrometers have the capability of simultaneously detecting the complete mass spectrum.

In time-of-flight mass spectrometry, a sample to be analyzed is introduced into an ionization region. The ions generated in the ionization region are accelerated by an electric field into a drift region.

$$E=\frac{1}{2}\,mv^2=Vq \tag{1}$$

$$v=\sqrt{\frac{2E}{m}}=\sqrt{\frac{2Vq}{m}}=\sqrt{2V}\,\sqrt{\frac{q}{m}} \tag{2}$$

$$t=\frac{d}{v}=\frac{d}{\sqrt{2V}}\,\sqrt{\frac{m}{q}} \tag{3}$$

Ideally, each ion enters the drift region with a kinetic energy E that is proportional to the charge q of the ion. The proportionality constant V is the potential difference across the ionization region. See equation 1. Each ion's velocity v in the drift region is proportional to the square root of the ion's charge-to-mass ratio. See equation 2. Thus, the time t it takes each ion to traverse the drift region, of length d, which is inversely proportional to the velocity v of the ion, is proportional to the square root of the ion's mass-to-charge ratio. See equation 3. The time interval between the formation of an ion and its arrival at the detector is recorded and the mass-charge ratios are derived therefrom. For gaseous samples, where the ions are produced in a relatively large volume, two acceleration regions may be used to determine a well defined flight time for each charge-to-mass ratio. Time-of-flight analyzers are simpler, more compact, lighter in weight, and more rugged than traditional analyzers and therefore are more suitable for use in the field.

Efforts have been made to combine conventional ionization techniques such as electron impact with time-of-flight analysis. The article, "An Electron Impact Storage Ion Source For Time-Of-Flight Mass Spectrometers", *International Journal of Mass Spectrometry and Ion Processes*, R. Grix et at., 1989, p. 323–330 ("Grix") discloses an electron impact ion source that continuously produces ions, stores those ion, and releases the ions in bursts of about 10 nanoseconds ("ns") duration. This ion source is then used for time-of-flight mass spectrometry.

Time-of-flight mass spectrometry of ions requires that the ions be gated into the drift region, i.e., introduced as temporal pulses of ions. The conventional method for introducing temporal pulses of ions into the drift region is the pulsed ionization/extraction method. This method requires elaborate pulsers and pulsing schemes which are a major complication for field portable instruments. Moreover, the uncertainty of the variables involved in pulsed ionization/extraction processes results in measurements having relatively poor mass resolution. Mass resolution is the ratio of the mass of a received particle to the error in determining the mass. Because it is a ratio of a mass to a mass, mass resolution is dimensionless. For instance, if a particle is determined to have a mass of twenty-eight atomic mass units give or take a tenth of a mass unit, the mass resolution is 280. Mass resolution in mass spectrometry is important both for determining the identity of the unknown compound and for elimination of other compounds from the set of potential compounds being analyzed. Consequently, the better the mass resolution a mass spectrometer achieves, the more accurate the spectrometer is, and hence, the more useful it is. The pulsed ionization/extraction method may provide an insufficient mass resolution due to relatively long electron pulse widths, on the order of about 10 ns. The uncertainty in the start time of the ion's travel leads to an uncertainty in the overall time-off-flight from which the mass of the ions is calculated. Existing technology does not include a portable electron-impact ion source having a pulse width significantly less than 10 ns.

Accordingly, a need has arisen for a compact, portable mass spectrometer with improved mass resolution and sensitivity.

SUMMARY OF THE INVENTION

The present invention provides a time-of-flight mass spectrometer for analyzing a sample. The sample can be a gas, a volatile liquid, a volatile solid, or small particles carried by a fluid. The spectrometer includes a low pressure enclosure having an ionization region and a sample inlet. The sample is introduced into the ionization region through the sample inlet. The spectrometer also includes an electron multiplier within the enclosure for producing an electron avalanche directed into the ionization region. A start detector, which generates a start signal when the electron avalanche is produced, is coupled to the electron multiplier. A stop detector, which generates a stop signal in response to the arrival of ions from the ionization region, is located within the enclosure at a predetermined distance from the ionization region.

An alternate embodiment of the present invention provides a time-of-flight mass spectrometer for analyzing a sample which includes a low pressure enclosure having an ionization region and a sample inlet. The sample is introduced into the ionization region through the sample inlet. The spectrometer also includes an electron multiplier within the enclosure for producing an electron avalanche directed along a path into the ionization region. A start detector, which generates a start signal in response to the impact of electrons, is positioned in the enclosure and in the path facing the ionization region. As in the preferred embodiment, a stop detector, which generates a stop signal in response to the impact of ions from the ionization region, is located within the enclosure at a predetermined distance from the ionization region.

In another feature of the present invention, molecules, clusters, aerosols, or microscopic particles are brought into the ionization region by a helium jet or other neutral gas carrier. If desired, the mass spectrum obtained and the coordinates of the region where the particles are extracted from can be recorded together for spatial mass analysis.

In another feature of the present invention, the start signal is obtained directly from the electron multiplier leads or bias cables. The low pressure enclosure includes a sample outlet and the sample flows into the inlet through the ionization region and out of the outlet. The flow of the sample is perpendicular to the path of the electron avalanche and perpendicular to the path of ions toward the stop detector.

In another feature of the present invention, the sample in a gaseous phase flows through the electron multiplier in order to be ionized.

In another feature of the present invention, an energy source activates the electron multiplier. The energy source emits photons, energetic electrons, ions, or neutrals. The energy source is a device selected from the group consisting of a radioactive source, an electric field emitter, an electron gun, and a photon emitter. The electron multiplier is a device selected from the group consisting of a continuous dynode electron multiplier, a discrete dynode electron multiplier, a microchannel plate, a grid multiplier, and a channel electron multiplier.

The present invention provides a method of analyzing a volatile or gaseous sample which includes triggering an electron multiplier to produce an electron avalanche directed into an ionization region. A low pressure enclosure contains the electron multiplier and the ionization region. The start signal can be obtained from the device that triggers the electron avalanche, from the electron multiplier or from an anode hit by the electron avalanche. The sample is directed into the ionization region. The electron avalanche collides with the sample such that ions are formed. Magnetic and electric fields can be used to achieve trajectories with maximum ion production. The ions are accelerated toward a stop detector that generates a stop signal upon their arrival.

The present invention provides an ion source which is compact, light weight, and which generates ion pulses having a temporal width of substantially 1 ns. The short pulse length provides better mass resolution for time-of-flight analysis.

BRIEF DESCRIPTION OF THE DRAWINGS

The above-noted and other aspects of the present invention will become more apparent from a description of the preferred embodiment when read in conjunction with the accompanying drawings. The drawings illustrate the preferred embodiment of the invention. In the drawings the same elements have the same reference numerals.

FIG. 7 depicts an ion source constructed according to an alternate embodiment of the present invention, including an annular electron multiplier.

FIG. 9(*a*) depicts a front view of an ionization container, constructed according to an alternate embodiment of the present invention.

FIG. 9(*b*) depicts a side view of the ionization container of FIG. 9(*a*).

FIG. 9(*c*) depicts a back view of the ionization container of FIG. 9(*a*).

FIG. 10, depicts a mass spectrometer constructed according to an alternate embodiment of the present invention, including the ionization container of FIG. 9(*a*).

DETAILED DESCRIPTION OF THE PREFERRED EMBODIMENTS

Figure 1:
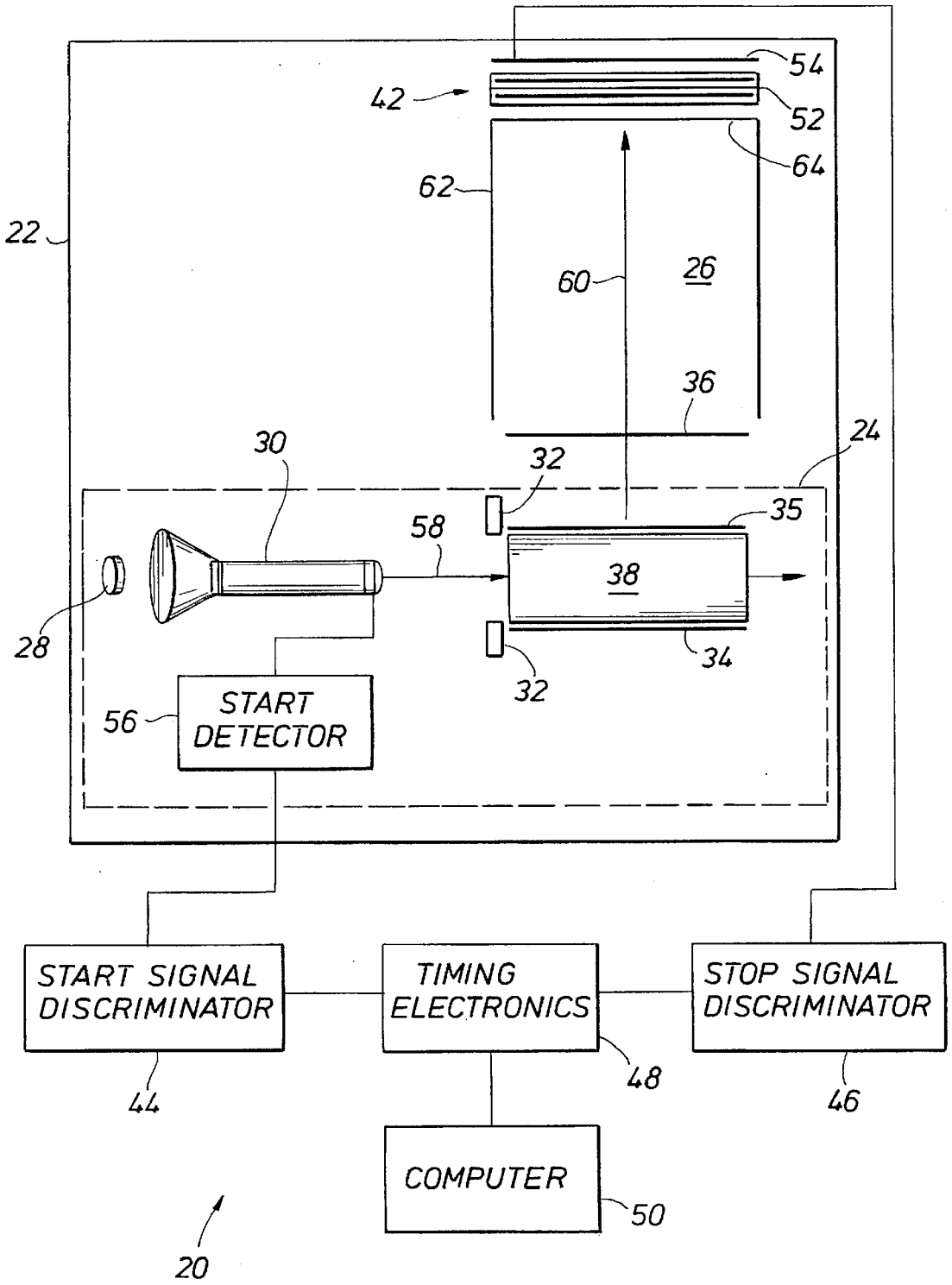
FIG. 1 depicts a mass spectrometer apparatus constructed according to the preferred embodiment of the present invention, including a Channeltron™ electron multiplier.

FIG. 1 depicts a mass spectrometer constructed according to the preferred embodiment of the present invention, using a Channeltron™electron multiplier. The spectrometer 20 is used to analyze a sample 40. The sample 40 can be a gas, a volatile liquid, a volatile solid, a helium jet or neutral gas carrier containing molecules, clusters, aerosols, or other microscopic particles. The spectrometer 20 includes a low pressure enclosure 22 containing an ion source 24 and a flight region 26. The low pressure enclosure 22 is depressurized using an evacuation pump. The evacuation pump is a turbomolecular pump which is capable of reducing the pressure to less than $10^{-4}$ torr. Pressures in the range of $5\times10^{-6}$ to 5×10–5 torr are preferred. The ion source 24 includes an energy source 28, an electron multiplier 30, electrodes 32, 34, 35, 36 and an ionization region 38. The ionization region 38 is the space inside the ion source 24 between the electrodes 34 and 35. The electron multiplier 30 is a channel electron multiplier. Galileo Electro-Optics Corporation of Sturbridge, Mass. makes a channel electron multiplier under the trademark "Channeltron". A channel electron multiplier is a nonmagnetic device which is formed from a special formulation of heavily lead-doped glass. A potential difference is applied across the electron multiplier 30 to allow the wall of the electron multiplier 30 to replenish its charge and to accelerate the electrons inside.

The mass spectrometer 20 also includes a stop detector 42, two discriminators 44, 46, a timing electronics unit 48, and a computer 50. The stop detector 42 includes microchannel plates 52 and a stop anode 54. A start detector 56 is connected if necessary via a pulse inverter to the discriminator 44. In an alternate embodiment the start signal is delivered directly from the electron multiplier 30 to the timing electronics unit 48. The start detector 56 is a capacitor in series with a resistor. The capacitor is connected to the electron multiplier 30. The voltage at the connection between the capacitor and the resistor is input to the discriminator 44. In an alternate embodiment, the capacitor is connected to the electron multiplier 30 and to the discriminator 44, and no resistor is used. In still another alternate embodiment, a capacitor is connected to an electrode in the path of the electron beam generated by the electron multiplier 30. The stop detector 42 is connected to the discriminator 46. The discriminators 44, 46 are connected to the timing electronics unit 48 which is connected to the computer 50. In the preferred embodiment, the computer 50 is a laptop or portable computer which may easily accompany the mass spectrometer 20. In the preferred embodiment, the timing electronics unit 48 is a transient recorder made by Precision Instruments of Knoxville, Tenn. In an alternate embodiment, the timing electronics unit 48 is a digital oscilloscope. In another alternate embodiment, the timing electronics unit 48 is a time-to-digital converter (TDC).

The energy source 28 is a radioactive source that emits energetic particles which are randomly distributed in time. An α-particle radioactive source ($^{230}$Th, half life 80,000 years, activity 0.1 μ Ci) is used.

In an alternate embodiment, the energy source 28 is an electric field emitter. The electric field emitter is a device formed by two electrodes at room temperature. Each electrode is a device selected from the group consisting of a grid, a tip, a flat plate, and a conducting surface with whiskers. Preferably, one electrode is a flat plate and the other is a metallic grid. One electrode emits thousands of electrons per square centimeter per second. When biased negatively with respect to the electron multiplier 30, this electrode provides a source of electrons. Each electron, after being accelerated up to a kinetic energy of about 1 keV, arrives at the electron multiplier 30. The electron emission process is random, but occurs at a fairly constant rate. This rate is varied by changing the electric field between the electrodes.

In another alternate embodiment, the energy source 28 is an electron gun. A narrow and very weak electron beam, produced by a small electron gun, is introduced in the electron multiplier 30 in order to initiate an electron avalanche 58.

In another alternate embodiment, the energy source 28 is a photon emitter in the UV region. A light emitting diode ("LED") is a small, inexpensive and simple photon emitter. The LED can be operated to emit photons continually, or in repetitive pulses.

In an alternate embodiment, the electron multiplier 30 is a multichannel plate ("MCP") arrangement. One or more multichannel plates are used. MCPs are devices in which a very fast multiplication of electrons is obtained in a small region called a channel. A plurality of channels, $10^4$ to $10^7$, are formed parallel to one another on a plate. Each channel is about 1 mm long and about 10–20 μm in diameter. Other dimensions are also possible. A voltage drop of about 900 to 1000 V between the faces of the plates is provided. For an applied bias of substantially 1 kV, the multiplication factor is about $10^3$. The use of 2 to 3 MCPs in series yields a total multiplication factor of $10^6$ to $10^9$ in a few nanoseconds. The output of the MCPs is a large, fast pulse of electrons referred to as an "electron avalanche". Galileo Electro-Optics Corporation of Sturbridge, Mass. manufactures MCPs. Other companies manufacture MCPs as well.

In another alternate embodiment, a continuous dynode electron multiplier (CDEM) is used as the electron multiplier 30. For example, a continuous dynode electron multiplier device made by Detector Technology, Inc. (DeTech) under the name EverLast CDEM or Segmented CDEM is used. In another alternate embodiment, the electron multiplier 26 is a discrete dynode type of electron multiplier.

Particles from the energy source 28 collide with the electron multiplier 30 and produce electrons. The electrons activate the multiplier 30 which produces the electron avalanche 58 directed toward the ionization region 38. The electron avalanche 58 is a large number of electrons released during a short time period. A short temporal pulse of particles from the energy source 28 will produce a short temporal electron avalanche 58 from the multiplier 30. The ability of the mass spectrometer 20 to correctly identify the mass of ions produced from the sample is partially dependent upon the time period of the electron avalanche 58. A better mass resolution is obtained with an electron avalanche 58 having a shorter time period than one with a longer time period.

In time-of-flight mass spectrometers, mass resolution is conventionally defined as $(T/\Delta T)/2$, where T is the average flight time of the ions and ΔT is the variance of the ion flight times, i.e., the full width of the ion pulse at half maximum. ΔT has two types of contributions: a) ΔTOF, the variation in the time-of-flight of the ions, and b) $\Delta T^0$, the sum of the variation in other contributions to the observed flight time such as the time-of-flight of electrons between the origination point and the ionization region, signal delays in cables, etc. Hence:

$$(\Delta T)^2=(\Delta TOF)^2(\Delta T_0)^2 \quad (4)$$

Because T is fixed by the drift length, the acceleration voltage, and the mass of the ion, maximization of the mass resolution requires minimization of ΔT, i.e., minimization of $\Delta T_0$ and ΔTOF. Minimizing $\Delta T_0$ requires the generation of relatively short duration signals and the appropriate electronics with which to analyze those signals. To reduce ΔTOF, appropriate ion optics are required. There are three causes of ΔTOF: a) ions are not produced at equal distance from the stop detector (space resolution); b) ions have different initial velocities (energy resolution); and c) ions do not have the same trajectories (electric field inhomogeneities). To optimize the space resolution, two different electric fields are needed.

When attempting to analyze unknown volatile compounds, high mass resolution is particularly important. Unequivocal identification of $CO^+$, $N_2^+$, or $C_2H_4^+$, all of nominal mass twenty-eight atomic mass units (amu), requires a mass resolution of several thousand. With a one ns electron pulse width, correctly shaped ion trajectories, and commercial timing electronics, mass resolutions of up to 8000 can be attained for a sample having an atomic mass of twenty-eight amu.

The electron avalanche 58 generates a start signal that is passed on to the discriminator 44. The discriminator 44 filters out electronic noise from the electron multiplier 30 and for each start signal delivers a pulse to the timing electronics 48.

The electrode 32 is maintained at a predetermined voltage to control the kinetic energy of the electrons in the electron avalanche 58 before they enter the ionization region 38. The electrode 32 may be used as a slit to define the width of the region 38. The energetic electrons in the electron avalanche 58 ionize the sample 40 which releases ions 60. A voltage difference is applied between the electrode 34 and the electrode 35. A voltage difference is also applied between the electrode 35 and the electrode 36. The voltage differences accelerate the ions 60 toward the stop detector 42 and into the flight region 26. In another alternate embodiment, negative ions are detected by reversing the polarity of electrodes 34, 35, 36. The initial energy distribution of the ions generated in the ionization region 28 contributes less to the total flight time of the ions when the voltage difference between the electrodes 34, 35, 36 is high. However, the high voltage difference modifies the electron trajectories and decreases space resolution.

The ions 60 exit the ionization region 38 and pass through the electrodes 35, 36 to enter the flight region 26. The electrodes 35, 36 do not intercept a substantial portion of the ions 60. The flight region 26 is bounded by a metal tube 62 that provides shielding against electric fields produced by other sources. The tube 62 is made with a conductive material. The end 64 of the tube 62 is a high transmission grid in the preferred embodiment and does not intercept a substantial portion of the ions 60. In the preferred embodiment, the electrode 34 is grounded, the tube 62 is about two inches long, and is biased at about 5 kV of electric potential. If higher resolution is needed, the length of the tube 62, and the electric potential are increased. There is no electric field in the flight region 26 and the ions 60 pass through the flight region 26 at a constant velocity. Undesirable stop signals due to electrons are eliminated by applying a magnetic field around the tube 62. In an alternate embodiment, the tube 62 is made of a non-conductive material, there is an electric field in the flight region 26, and therefore the ions 60 are accelerated.

The ions 60 interact with stop detector 42 after exiting the flight region 26. In response to the interaction, the stop detector 42 generates a stop signal that is passed on to the discriminator 46. The discriminator 46 filters out electronic noise from the stop detector 42 and delivers a pulse with appropriate shape to the timing electronics unit 48.

The timing electronics unit 48 provides a digital word indicative of the time difference between the start signal and the stop signal to the computer 50. A mass spectrum is formed from a frequency analysis of these time intervals.

The sample 40 flows in a preferred direction that is perpendicular to both the direction of the electron avalanche 58 and the direction of the ions 60. In addition, the direction of the electron avalanche 58 is perpendicular to the direction of the ions 60. Uncertainties in the flight time of the ions 60 are caused when the ions 60 start at different points in the ionization region 38 and when the ions 60 have different initial kinetic energies. The perpendicular arrangement of the sample 40 flow and the path of the ions 60 partially reduces these uncertainties.

The electron avalanche 58 produces an abundance of ions 60. Therefore, for quantitative measurements, the detection scheme is designed to account for a multiplicity of ions of equal mass-to-charge ratio. The length of flight region 26 is calculated such that ions of equal mass-to-charge ratio reach the stop detector 42 simultaneously. The ion time-of-flight computed from the start and stop signals may be used to determine the mass of the sample species. The mass resolution depends on the width of the electron pulse, the length of the flight region 26, and the initial kinetic energy distribution of the ions 60.

Figure 2:
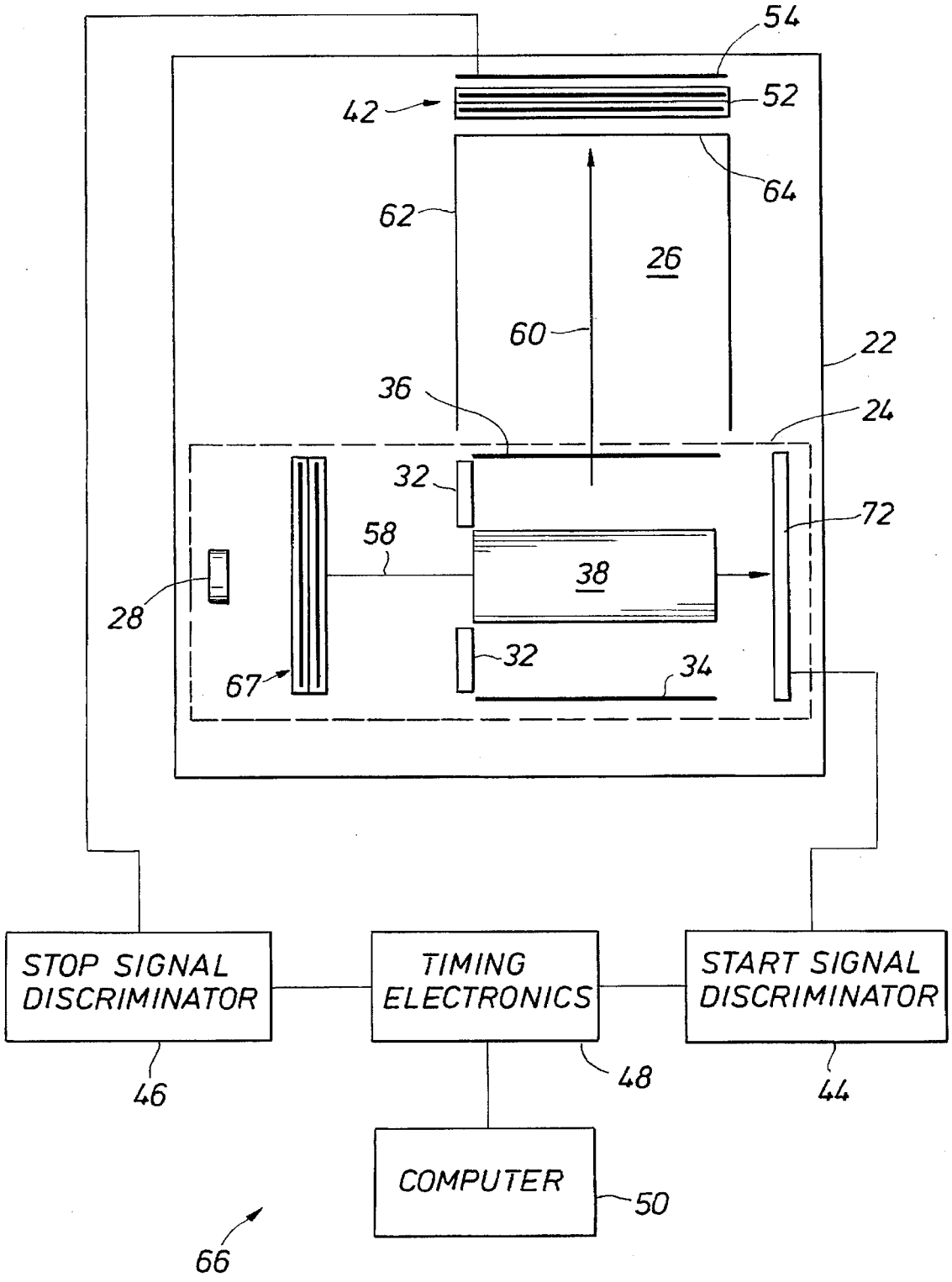
FIG. 2 depicts a top view of a mass spectrometer apparatus including timing analysis devices constructed according to an alternate embodiment of the present invention.
Figure 3:
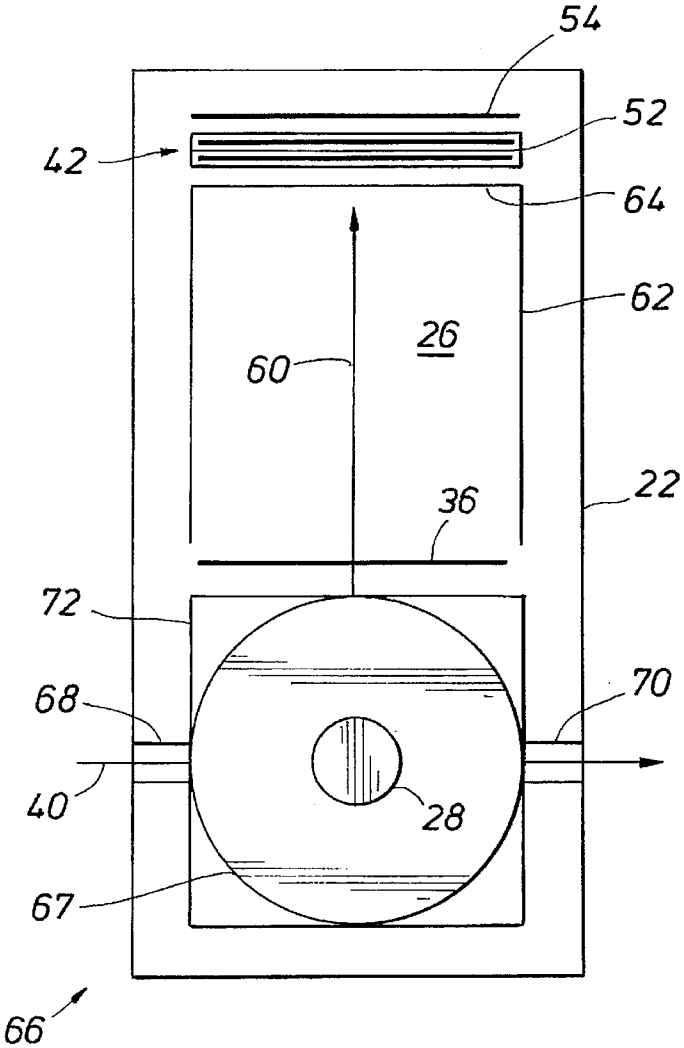
FIG. 3 depicts a side view of the mass spectrometer apparatus in FIG. 2.

FIG. 2 depicts a top view of a mass spectrometer apparatus, including timing analysis devices, constructed according to an alternate embodiment of the present invention. FIG. 3 depicts a side view of the mass spectrometer apparatus of FIG. 2. Referring to FIGS. 2 and 3, a mass spectrometer 66 includes the low pressure enclosure 22. The low pressure enclosure 22 includes an ion source 24, and the flight region 26. The sample 40 flows through a sample inlet 68, (shown in FIG. 3) into the ionization region 38, and through a sample outlet 70 (shown in FIG. 3.) The sample 40 flows out of the plane of the page in FIG. 2.

The sample inlet 68 is adapted to receive samples from the needle of a syringe. The sample inlet 68 is also adapted to receive samples from a slip stream taken from a gas stream output of a separation device. The separation device can be a chromatograph. The sampling can be conducted utilizing a programmable valve. Flow of the sample 40 through the ionization region 38 is stabilized at the operating pressure of the low pressure enclosure 22 before activating the spectrometer 66. The sample 40 is leaked into the ionization region 38 due to the pressure differential between the atmospheric pressure and the pressure in the low pressure enclosure 22.

Referring again to FIG. 2, the mass spectrometer 66 also includes an electron multiplier 67, the energy source 28, three electrodes 32, 34, 36, a start anode 72, the stop detector 42, two discriminators 44, 46, the timing electronics unit 48, and the computer 50. The stop detector 42 includes microchannel plates 52 and a stop anode 54. Other types of stop detectors include sets of multichannel plates with ion-electron converter surfaces, channeltrons with ion-electron converter surfaces, charge sensitive detectors (such as silicon and germanium detectors), and photon detectors. The start anode 72 is connected to the discriminator 44. The stop detector 42 is connected to the discriminator 46. The two discriminators 44, 46 are connected to the timing electronics unit 48 which is connected to the computer 50.

The electron multiplier 67 is an MCP assembly. The energy source 28 triggers the electron multiplier 67. The electron multiplier 67 generates an electron avalanche 58 directed toward the ionization region 38. The energetic electrons in the electron avalanche 58 ionize the sample 40 which releases ions 60.

The electron avalanche 58 strikes the start anode 72 after it ionizes the sample 40. In response to being struck, the start anode 72 generates a start signal that is passed on to the discriminator 44. The discriminator 44 filters out electronic noise from the start anode 72 and relays only the start signal to the timing electronics 48.

The ions 60 traverse the flight region 26 and strike the stop detector 42. In response to being struck, the stop detector 42 generates a stop signal that is passed on to the discriminator 46. The timing electronics 48 and computer 50 correlate the data received from the discriminators 44, 46.

Figure 4:
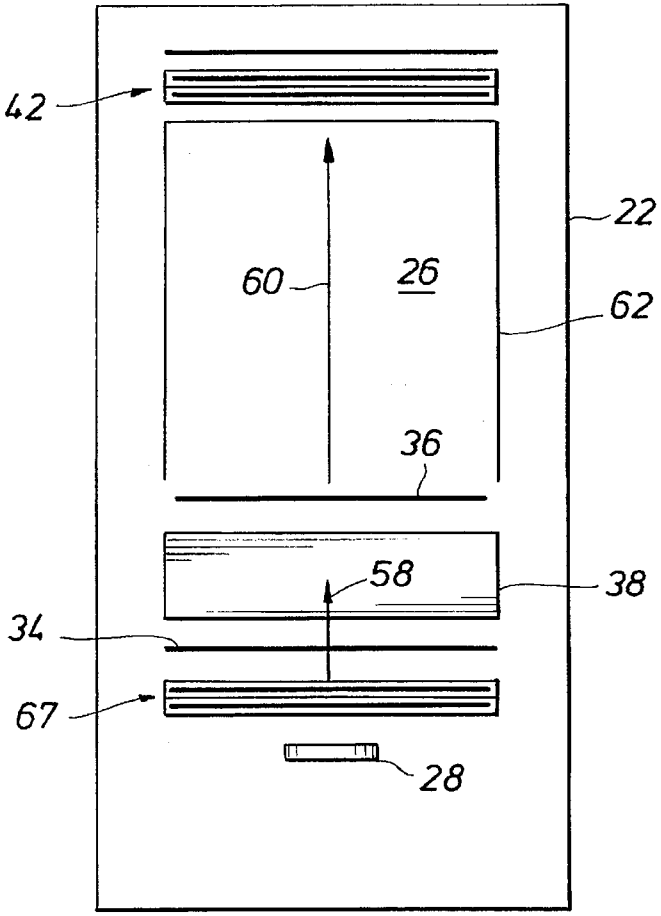
FIG. 4 depicts a mass spectrometer apparatus having parallel electron avalanche and ion paths, constructed according to an alternate embodiment of the present invention.

FIG. 4 depicts a mass spectrometer having parallel electron avalanche and ion paths, constructed according to an alternate embodiment of the present invention. The mass spectrometer includes the low pressure enclosure 22 containing the energy source 28, the electron multiplier 67, two electrodes 34, 36, the ionization region 38, the metal tube 62, the flight region 26, and the stop detector 42. The electron multiplier 67 is a multichannel plate ("MCP") arrangement. Two multichannel plates are used. The stop detector 42 is an MCP arrangement with an anode.

A sample flows into the plane of the page and through the ionization region 38. The electron avalanche 58 produced by the electron multiplier 67 collides with the sample 40 and produces ions 60 that are accelerated by a potential difference applied between the electrodes 34, 36. The potential difference applied between the electrodes 34, 36 accelerates the electrons back toward the electron multiplier 67. The ions 60 travel at a constant velocity through the flight region 26 within the metal tube 62. The ions 60 impact the stop detector 42 which produces a stop signal.

Figure 5:
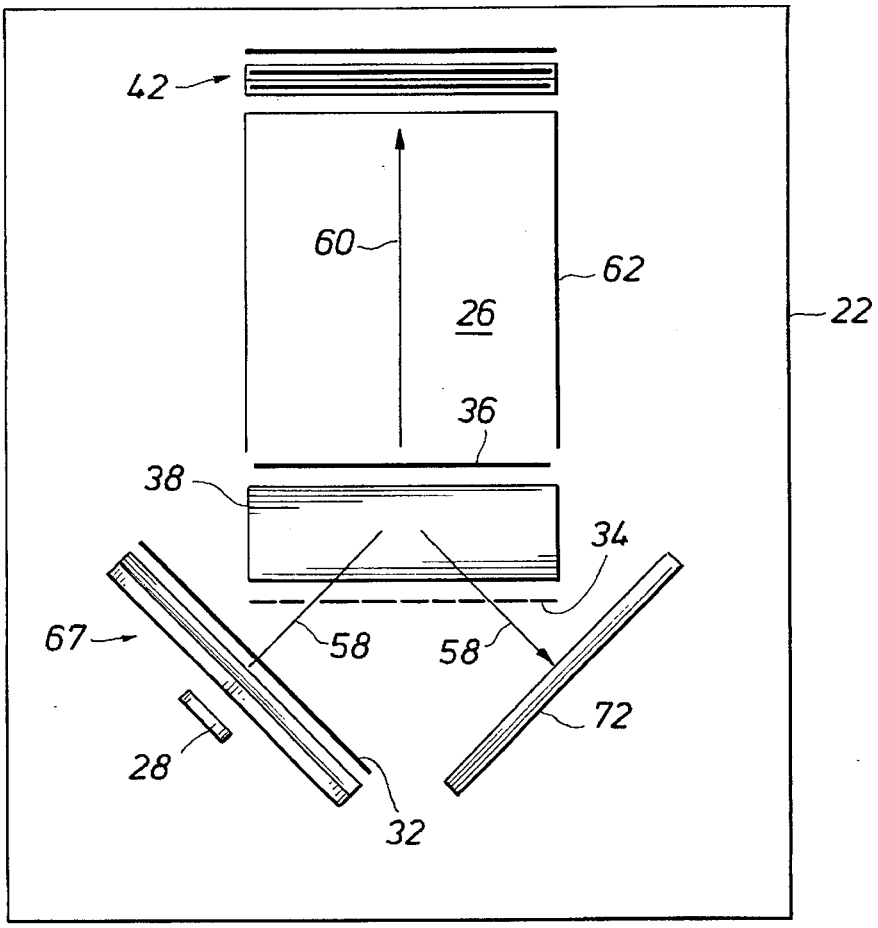
FIG. 5 depicts a mass spectrometer apparatus constructed according to an alternate embodiment of the present invention, in which the electron avalanche and ion paths make an acute angle.

FIG. 5 depicts a mass spectrometer apparatus constructed according to an alternate embodiment of the present invention in which the electron avalanche 58 and ion 60 paths are at an acute angle to each other. The mass spectrometer includes the low pressure enclosure 22 containing the energy source 28, the electron multiplier 67, three electrodes 32, 34, and 36, the ionization region 38, the metal tube 62, the flight region 26, the start anode 72, and the stop detector 42. The electron multiplier 67 is a multichannel plate "MCP") arrangement. Two multichannel plates are used. The stop detector 42 is an MCP arrangement with an anode.

A sample flows into the plane of the page and through the ionization region 38. The electron avalanche 58 produced by the electron multiplier 28 collides with the sample 40 and produces ions 60 that are accelerated by a potential difference applied between the electrodes 34, 36. A portion of the electrons in the electron avalanche 58 are reflected by the electric field in the ionization region 38 and activate the start detector 72. The start detector 72 generates a start signal in response to the electron avalanche 58. The ions 60 travel at a constant velocity through the flight region 26 within the metal tube 62. The ions impact the stop detector 42 which generates a stop signal.

Figure 6:
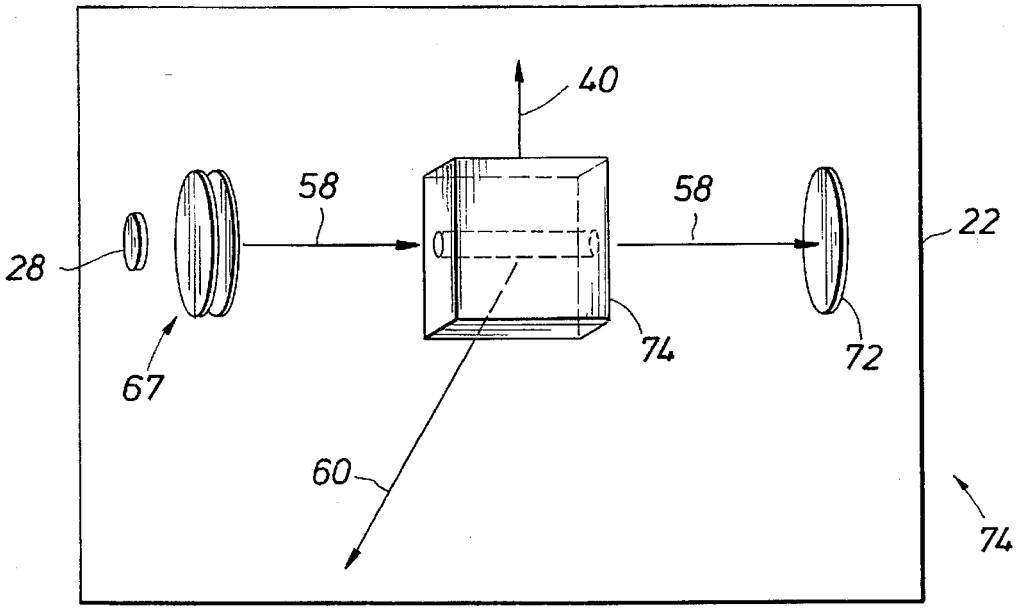
FIG. 6 depicts an ion source constructed according to an alternate embodiment of the present invention, including an ionization container.

FIG. 6 depicts an ion source constructed according to an alternate embodiment of the present invention including an ionization cell. The ion source 74 includes the low pressure enclosure 22 containing the energy source 28, the electron multiplier 67, the start anode 72, and an ionization cell 74. A potential difference is applied across the electron multiplier 67. The electron multiplier 67 is a multichannel plate ("MCP") arrangement. One or more multichannel plates may be used.

The energy source 28 releases energetic particles that activate the electron multiplier 67. The electron multiplier 67 produces an electron avalanche 58 directed toward the ionization cell 74. The sample 40 flows vertically through the ionization cell 74. The electron avalanche 58 enters the ionization cell 74 and ionizes the sample 40. The ions 60 exit the ionization cell 74 in a path perpendicular to the path of the electron avalanche 58 and the sample 40. The electron avalanche 58 exits the ionization cell 74 and activates the start anode 72.

FIG. 7 depicts an ion source constructed according to an alternate embodiment of the present invention, including an annular electron multiplier. The ion source 76 includes the low pressure enclosure 22 containing an annular energy source 78, an annular electron multiplier 80, and the start anode 72. A potential difference is applied across the annular electron multiplier 80. The annular electron multiplier 80 is an annular multichannel plate "MCP") arrangement. One or more annular multichannel plates may be used.

The annular energy source 78 releases energetic particles that activate the annular electron multiplier 80. The annular electron multiplier 80 produces an electron avalanche 58 directed toward the start anode 72. The sample 40 flows through the annular energy source 78 and the annular electron multiplier 80. The electron avalanche 58 ionizes the sample 40. The ions 60 travel in a path perpendicular to the path of the electron avalanche 58 and the sample 40. The electron avalanche 58 activates the start anode 72.

Figure 8:
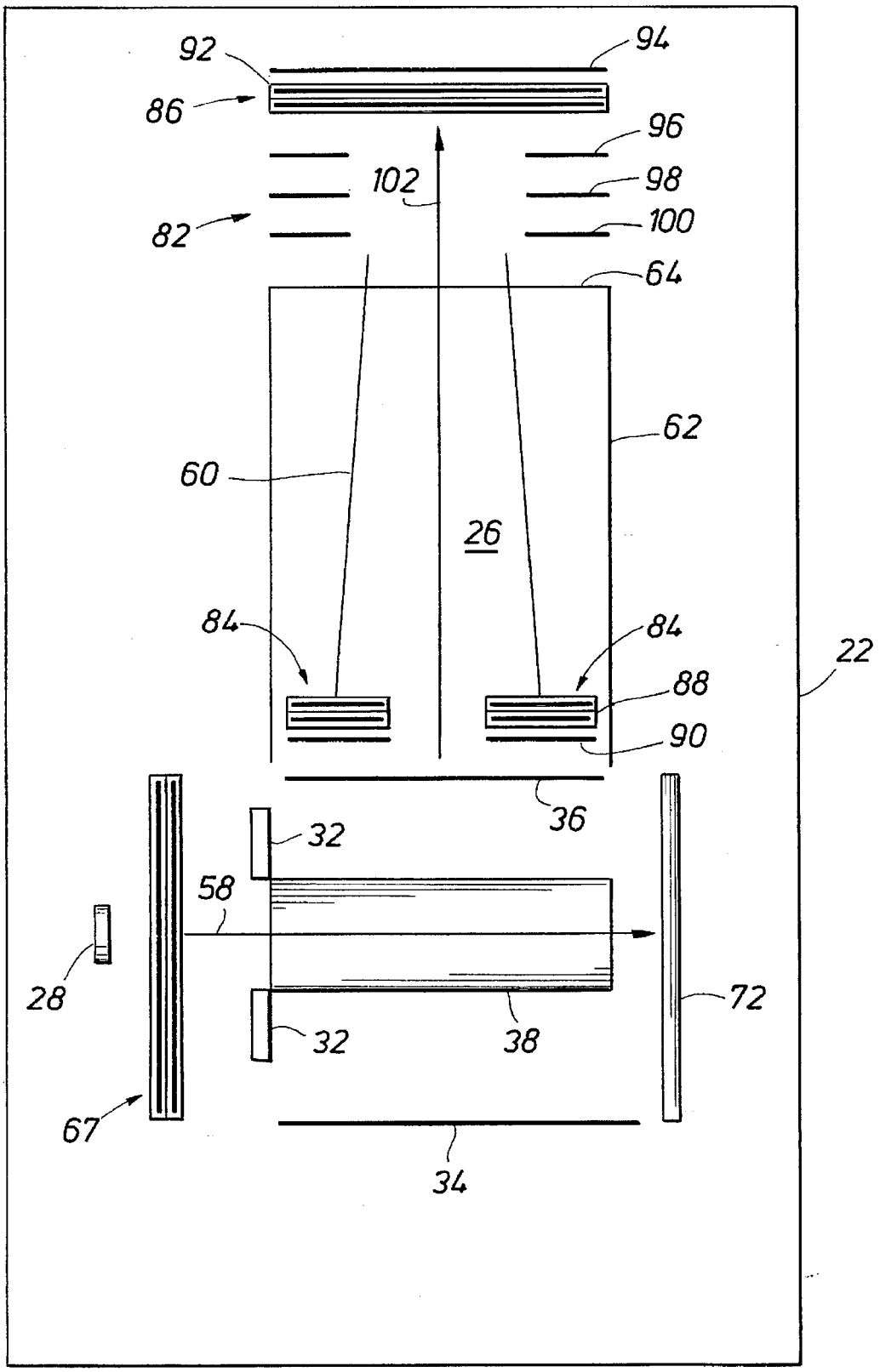
FIG. 8 depicts a mass spectrometer apparatus constructed according to an alternate embodiment of the present invention, including an ion mirror and an aunular stop detector.

FIG. 8 depicts a mass spectrometer constructed according to an alternate embodiment of the present invention including an ion mirror and an annular stop detector. The mass spectrometer includes the low pressure enclosure 22 containing the ionization region 38 and the flight region 26. A sample flows through the ionization region 38. The sample flows out of the plane of the page in FIG. 8.

The mass spectrometer also includes the electron multiplier 67, the energy source 28, three electrodes 32, 34, 36, the start anode 72, the metal tube 62, an ion mirror 82, an annular stop detector 84, and a neutral detector 86. The annular stop detector 84 includes annular microchannel plates 88 and an annular stop anode 90. The neutral detector 86 includes MCPs 92 and an anode 94.

The energy source 28 is a radioactive source. The electron multiplier 67 uses an MCP arrangement, with two multichannel plates. A voltage drop of about 900 to 1000 V between the faces of the plates is provided.

When particles from the energy source 28 reach the electron multiplier 67, they impact thereon and produce electrons. This activates the electron multiplier 67 which produces an electron avalanche 58 directed toward the ionization region 38.

In order to maximize the efficiency of the instrument, the electrode 32 is used to adjust the kinetic energy of the electrons in the electron avalanche 58 before they enter the ionization region 38. The energetic electrons in the electron avalanche 58 ionize the sample 40 which releases ions 60. The voltage difference applied between the electrode 34 and the electrode 36 accelerates the ions 60 toward the ion mirror 82 and into the flight region 26. The start anode 72 generates a start signal in response to being struck by the electron avalanche 58.

The ions 60 travel through the flight region 26 in the same manner as in FIG. 2 until they reach the ion mirror 82. When the ions 60 reach the ion mirror 82 they are accelerated in the direction of the annular stop detector 84 by an electric field. The electric field is generated by voltages applied to the mirror electrodes 96, 98, 100. The ions 60 change direction and reenter the flight region 26. The ions 60 travel at a constant velocity back through the flight region 26 in the embodiment where the flight region 26 is field-free. The ions 60 collide with the annular stop detector 84. Ions of the same mass having larger energies penetrate the ion mirror 82 more deeply and have longer flight paths, arriving at the annular stop detector 84 at about the same time as less energetic ions of identical mass. Therefore, any discrepancies among the initial kinetic energies of the ions 60 of the same mass are significantly reduced. The annular stop detector 84 generates a stop signal in response to the ion impact. Any energetic neutral particles 102 will pass through the ion mirror 82 without being accelerated by the electric field and will collide with the neutral detector 86. A portion of the ions 60 become energetic neutral particles 102 because of metastable dissociation occurring in the flight region 26. Upon impact with the neutral detector 86, the time of flight of the neutral particles is used to perform mass spectrometry according to a known method in the art for correlating neutral species with their associated reflected ion fragments to produce ion mass spectra. The neutral detector 86 will generate a collision signal in response to the impact of neutral particles 102.

FIG. 9(*a*) depicts a front view of an ionization cell constructed according to the present invention. FIG. 9(*a*) depicts a side view of the ionization cell of FIG. 9(*a*). FIG. 9(*c*) depicts a back view of the ionization cell of FIG. 9(*a*). The ionization cell 74 includes two conductive plates 106, 108, a capillary 110, and a circular insulating spacer 112. The conductive plate 108 includes an electron window 114.

The electron window 114 is composed of a material selected from the group comprising a thin metal foil having a thickness of 0.1 μm and a metallized free-standing polymer film having a thickness of 1 μm. The electron window 114 allows electrons to pass into the ionization container 74, but prevents gas or ions from leaving the ionization container 74. The conductive plate 106 includes a particle window 116. The capillary 110 is in fluid communication with the interior of the circular insulating spacer 112. A sample 40 is introduced into the container 74 through the capillary 110.

FIG. 10 depicts a mass spectrometer constructed according to an alternate embodiment of the present invention including an ionization cell. The energy source 28 activates the electron multiplier 67. The electron multiplier 67 generates an electron avalanche 58 that is focussed by the focussing electrode 118. The electron avalanche 58 enters the ionization cell 74 [see FIGS. 9(*a,b,c*)] at an angle and ionizes the sample 40 contained therein. A potential difference applied between the conductive plates 106, 108 of the ionization container 74 accelerates the ions toward the stop detector 120. The ions 60 pass through the metal tube 62 at constant velocity and collide with the stop detector 120. The stop detector 120 generates a stop signal in response to the collision.

Figure 11:
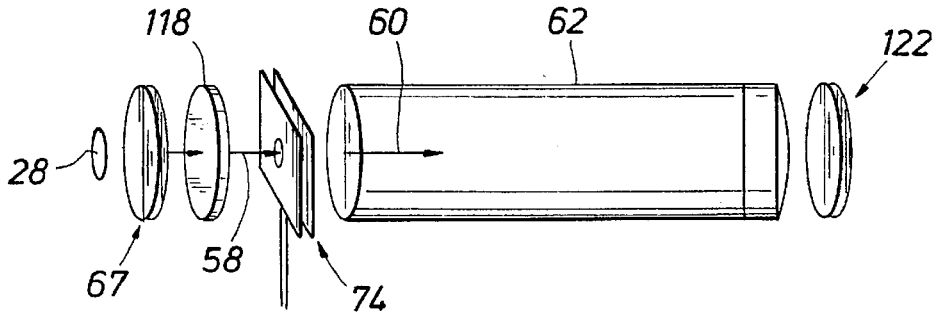
FIG. 11 depicts a linear mass spectrometer constructed according to an alternate embodiment of the present invention, including the ionization container of FIG. 9(*a*).

FIG. 11 depicts a linear mass spectrometer constructed according to an alternate embodiment of the present invention including an ionization cell. The energy source 28 activates the electron multiplier 67. The electron multiplier 67 generates an electron avalanche 58 that is focussed by the focussing electrode 118. The electron avalanche 58 enters the ionization cell 74 [see FIGS. 9(*a,b,c*)] and ionizes the sample contained therein. A potential difference applied between the conductive plates of the ionization cell 74 accelerates the ions toward the stop detector 122. The ions pass through the metal tube 62 at constant velocity and collide with the stop detector 122. The stop detector 122 generates a stop signal in response to the collision.

Figure 12:
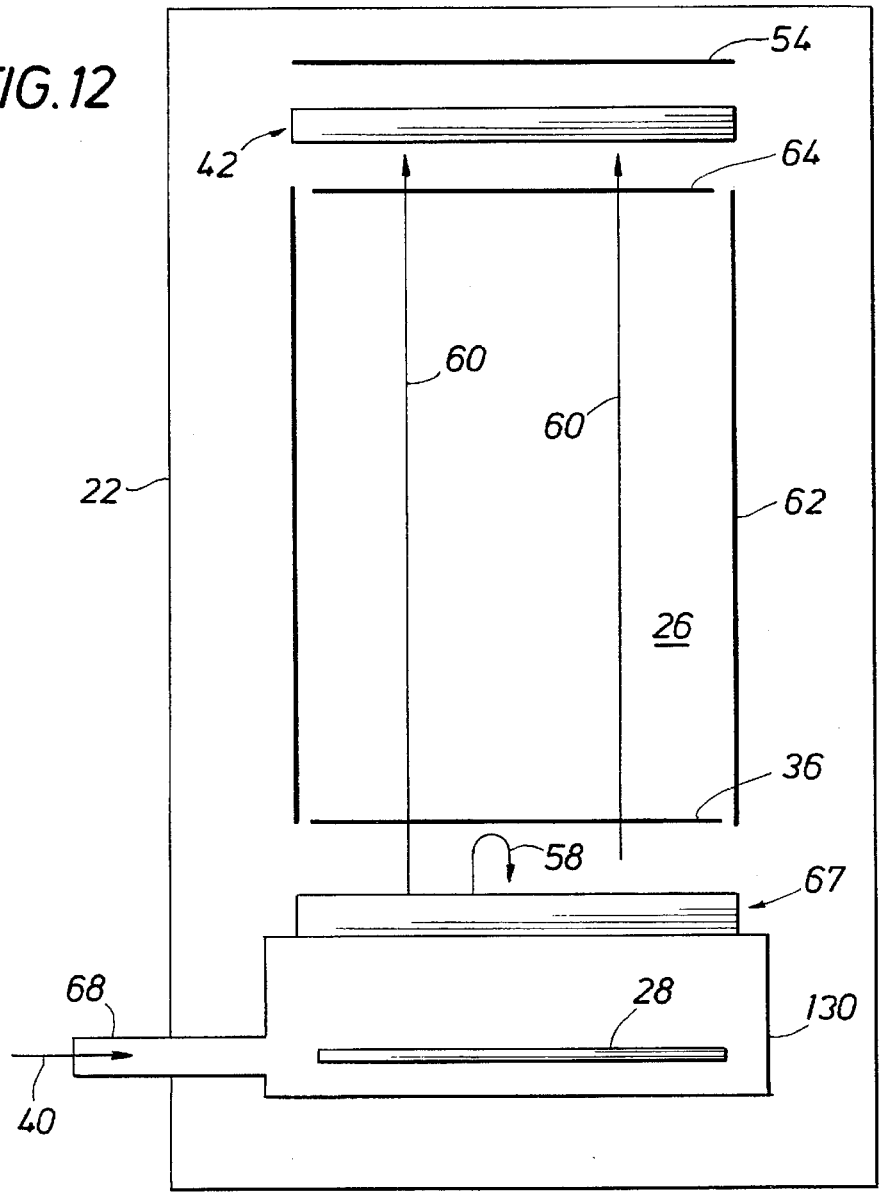
FIGS. 12 and 13 depict a mass spectrometer constructed according to an alternate embodiment of the present invention in which the sample flows through the electron multiplier.

FIG. 12 depicts a mass spectrometer constructed according to an alternate embodiment of the present invention in which the sample 40 flows through the electron multiplier 67. The sample 40 enters a sample container 130 through the sample inlet 68. Each microchannel plate of the electron multiplier 67 has channel through which the sample 40 exits the sample container 130. The electron multiplier 67 is activated by the energy source 28. The electrons produced within the electron multiplier 67 ionize the sample 40 flowing through the electron multiplier 67 producing ions 60. The electrode 36 is biased so that the ions 60 are accelerated towards the stop detector 42 and the electron avalanche 58 produced by the electron multiplier 67 is accelerated back toward the energy source 28. The ions 60 traverse the flight region 26 which is enclosed by the metal tube 62. The ions 60 pass through the end 64 of the tube 62 and arrive at the stop detector 42. The stop detector 42 includes a stop anode 54. The components of the spectrometer are enclosed by the low pressure enclosure 22.

Figure 13:
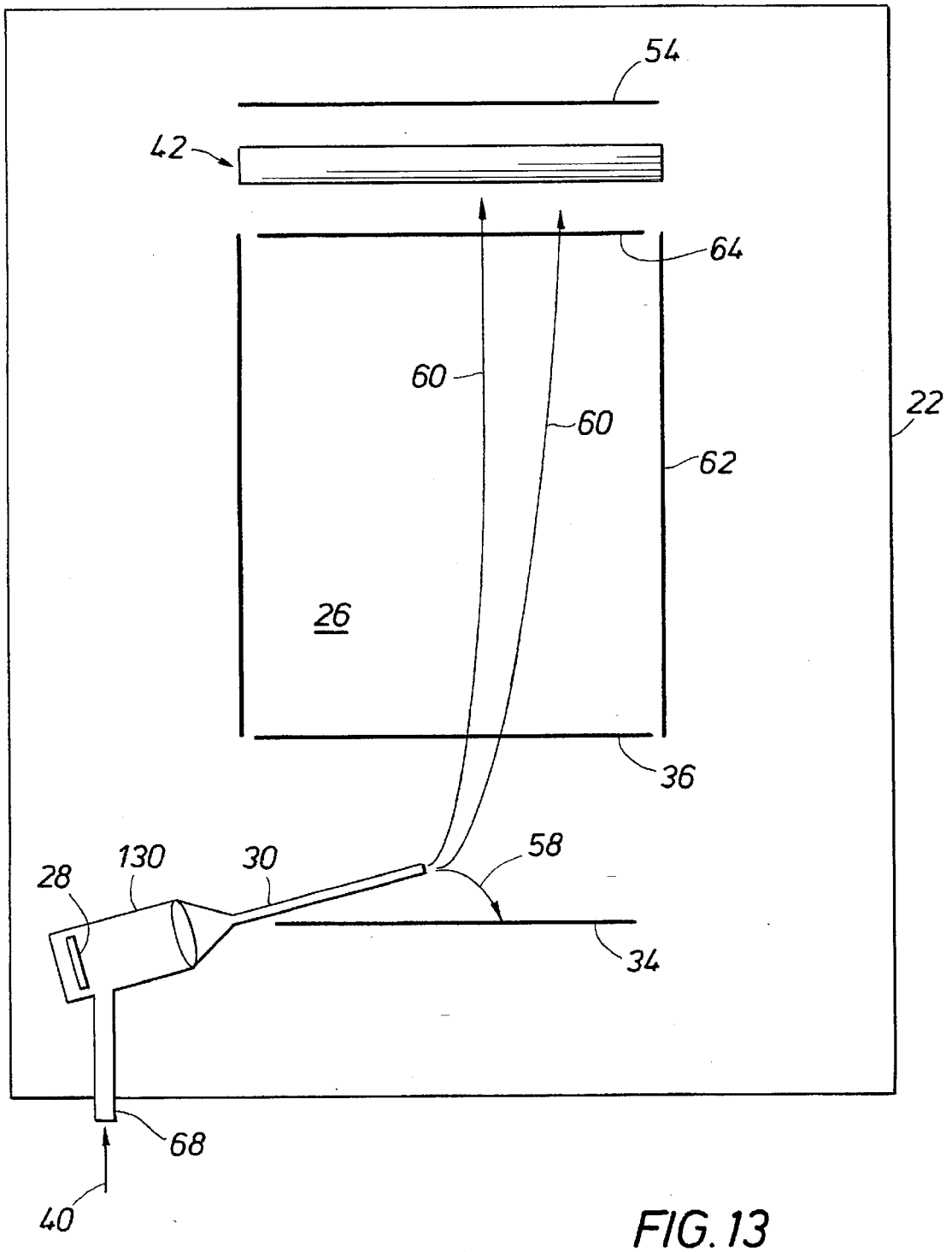

FIG. 13 depicts a mass spectrometer constructed according to an alternate embodiment of the present invention in which the sample 40 flows through the electron multiplier 30. The sample 40 enters a sample container 130 through the sample inlet 68. The electron multiplier 30 is hollow and the sample 40 exits the sample container 130 through the electron multiplier 30. The electron multiplier 30 is activated by the energy source 28. The electrons produced within the electron multiplier 30 ionize the sample 40 flowing through the electron multiplier 30 producing ions 60. The electrodes 34, 36 are biased so that the ions 60 are accelerated towards the stop detector 42 and the electron avalanche 58 produced by the electron multiplier 30 is accelerated back toward the energy source 28. The ions 60 traverse the flight region 26 which is enclosed by the metal tube 62. The ions 60 pass through the end 64 of the tube 62 and arrive at the stop detector 42. The stop detector 42 includes a stop anode 54. The components of the spectrometer are enclosed by the low pressure enclosure 22.

Figure 14:
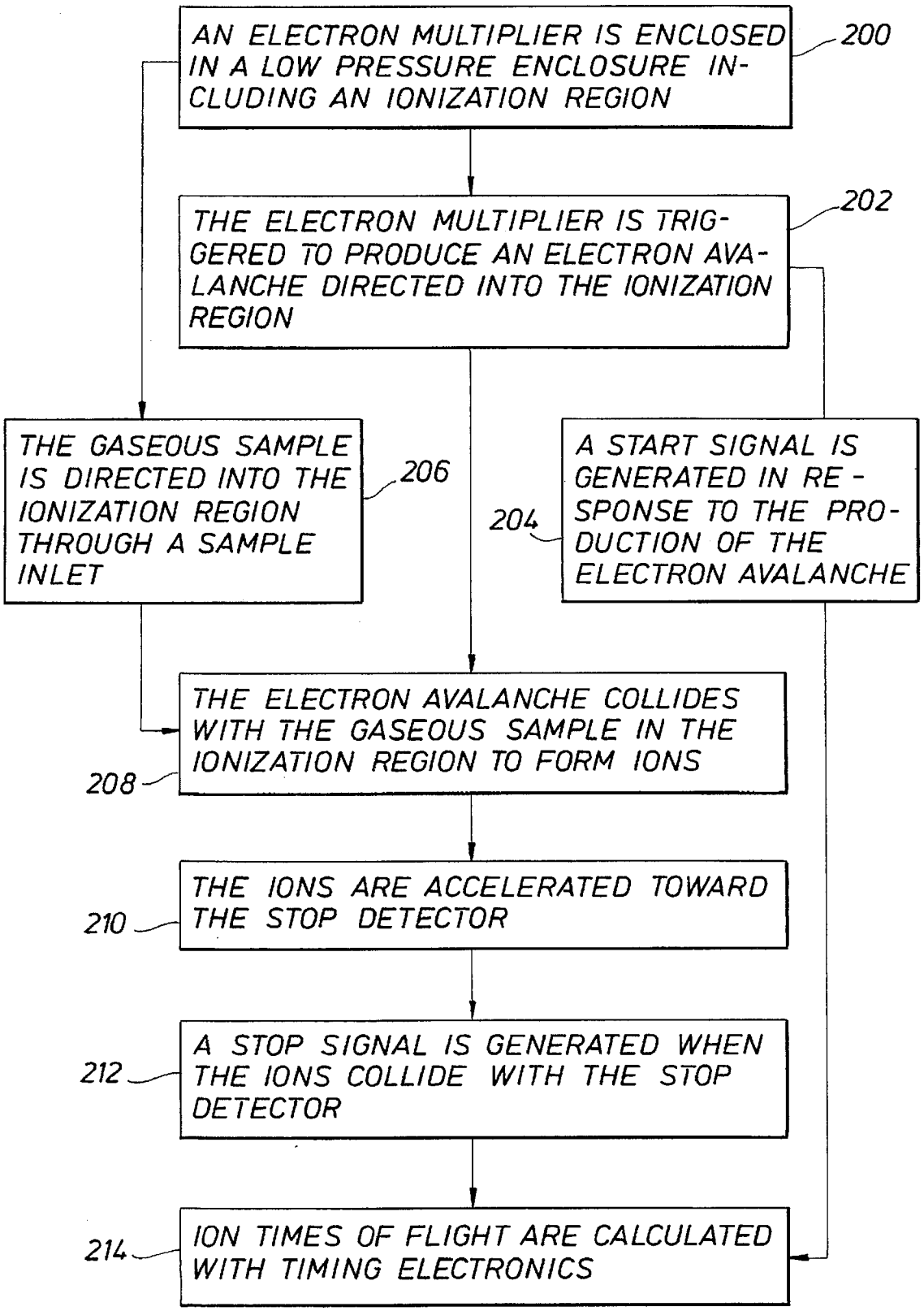
FIG. 14 depicts a schematic representation of the preferred method of analyzing a sample.

FIG. 14 depicts a schematic representation of the preferred method of analyzing a sample. In step 200, an electron multiplier is enclosed in a low pressure enclosure. The low pressure enclosure includes an ionization region. In step 202, the electron multiplier is triggered to produce an electron avalanche directed into the ionization region. In step 204, a start signal is generated in response to the production of the electron avalanche. In step 206, the sample is directed into the ionization region through a sample inlet. In step 208, the electron avalanche collides with the sample in the ionization region to form ions. In step 210, the ions are accelerated toward the stop detector. In step 212, the ions collide with the stop detector and a stop signal is generated. In step 214, ion times of flight are calculated with timing electronics.

Figure 15:
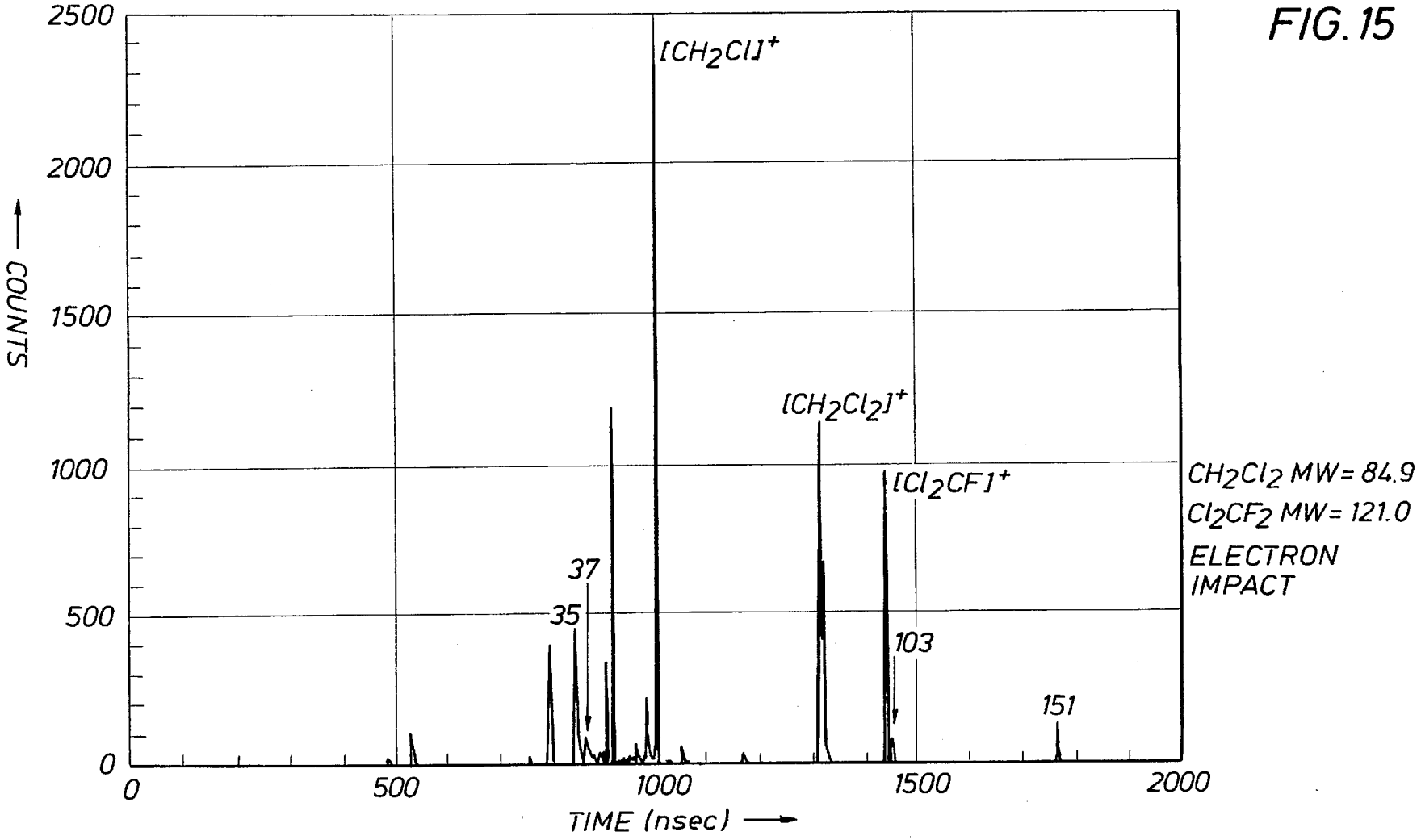
FIGS. 15 and 16 depict two mass spectra obtained by a mass spectrometer constructed according to the preferred embodiment of the present invention.
Figure 16:
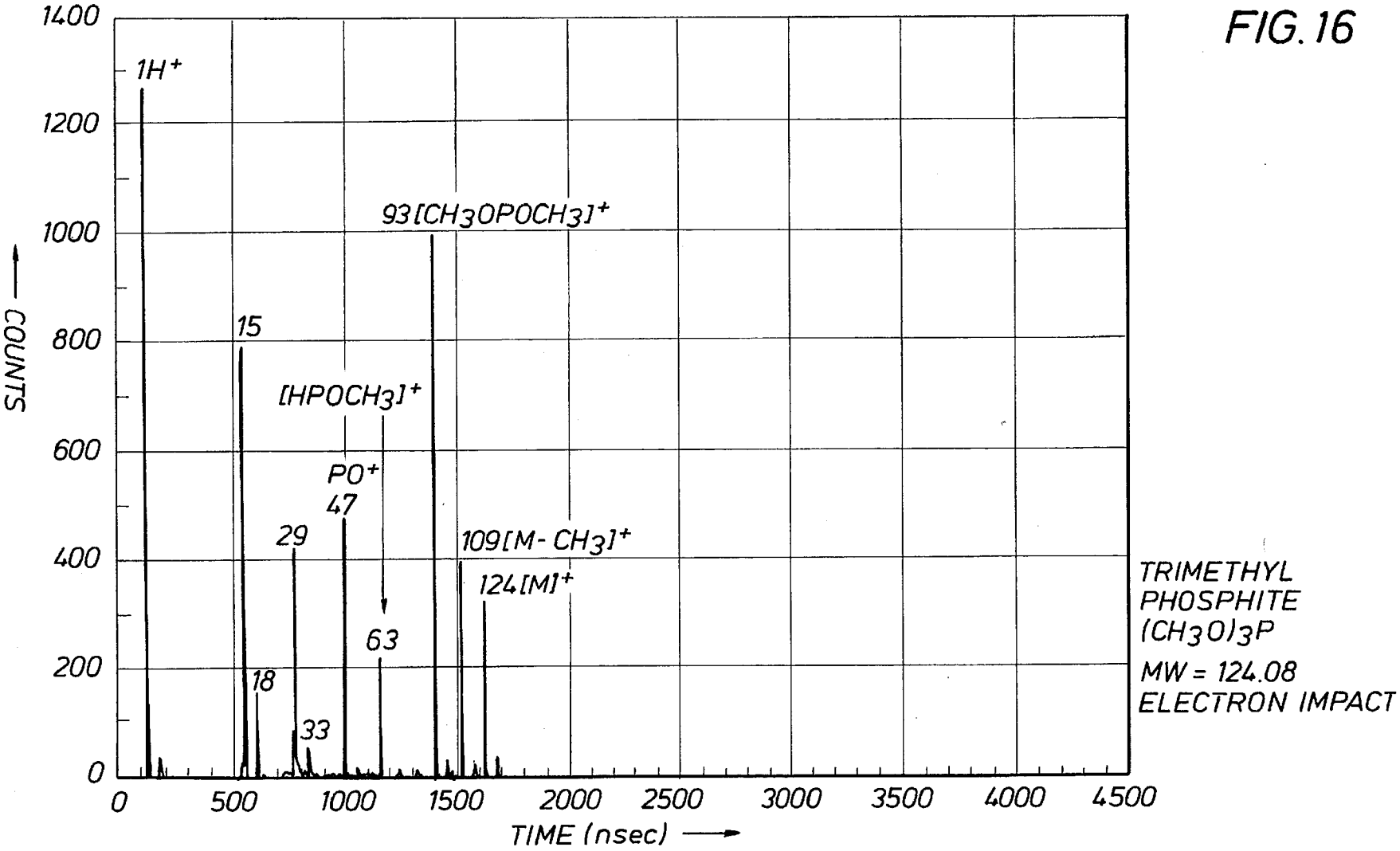

FIGS. 15 and 16 depict two mass spectra obtained by analyzing $(CH_3O)_3P$, $CH_2Cl_2$, and $Cl_2CF_2$ with a mass spectrometer constructed according to the preferred embodiment of the present invention.

The present invention provides a method and apparatus for analyzing a sample that has the benefit of being accurate, readily interfaced with sampling and preconcentration devices, simple, rugged, light, and small. The preferred embodiment has dimensions of substantially eighteen inches by twelve inches by four inches.

The principles, preferred embodiment, and modes of operation of the present invention have been described in the foregoing specification. The invention is not to be construed as limited to the particular forms disclosed, because these are regarded as illustrative rather than restrictive. Moreover, variations and changes may be made by those skilled in the art without departing from the spirit and scope of the invention as defined by the appended claims.

What is claimed is:

1. A mass spectrometer apparatus for analyzing a sample, comprising:

a low pressure enclosure having an ionization region and a sample inlet for introducing the sample into the ionization region;

an electron multiplier within the enclosure for producing an electron avalanche directed into the ionization region, the electron avalanche for generating ions with the sample;

a start detector coupled to the electron multiplier, the start detector responsive to the electron avalanche for generating a start signal; and a stop detector positioned within the enclosure at a predetermined distance from the ionization region, the stop detector responsive to the ions from the ionization region for generating a stop signal.

2. The mass spectrometer apparatus of claim 1 wherein the start detector is positioned in the low pressure enclosure between the electron multiplier and the ionization region.

3. The mass spectrometer apparatus of claim 1 wherein the low pressure enclosure includes a sample outlet, a straight line extending between the sample inlet and the ionization region defines a first path, a straight line extending between the electron multiplier and the ionization region defines a second path, and the second path is perpendicular to the first path.

4. The mass spectrometer apparatus of claim 3 further comprising a straight line extending between the stop detector and the ionization region defines a third path, and the third path is perpendicular to the first path.

5. The mass spectrometer apparatus of claim 1, further comprising:

first and second electrodes adjacent the ionization region for accelerating the ions toward the stop detector.

6. The mass spectrometer apparatus of claim 1 further comprising a conductive tube between the stop detector and ionization region.

7. The mass spectrometer apparatus of claim 1 further comprising a non-conductive tube between the stop detector and ionization region.

8. The mass spectrometer apparatus of claim 1, further comprising:

an energy source coupled to the electron multiplier, the energy source for activating the electron multiplier.

9. The mass spectrometer apparatus of claim 1, further comprising:

a focussing electrode positioned between the electron multiplier and the ionization region, the focussing electrode for constraining the electron avalanche.

10. The mass spectrometer apparatus of claim 1, wherein the stop detector comprises a device selected from the group consisting of a microchannel plate with an ion-electron converter surface, a charge sensitive detector, and a photon detector.

11. The mass spectrometer of claim 1 wherein the sample is directed through the electron multiplier.

12. A mass spectrometer apparatus for analyzing a sample, comprising:

a low pressure enclosure having an ionization region and a sample inlet for introducing the sample into the ionization region;

an electron multiplier within the enclosure for producing an electron avalanche directed into the ionization region, the electron avalanche for generating ions with the sample;

a start detector positioned in the low pressure enclosure facing the ionization region, the start detector responsive to an impact of electrons for generating a start signal; and a stop detector positioned within the enclosure at a predetermined distance from the ionization region, the stop detector responsive to the ions from the ionization region for generating a stop signal.

13. The mass spectrometer apparatus of claim. 12 wherein the electron multiplier comprises a microchannel plate.

14. The mass spectrometer apparatus of claim 13 wherein the microchannel plate is annularly shaped.

15. The mass spectrometer apparatus of claim 12 wherein the low pressure enclosure includes a sample outlet, a straight line extending between the sample inlet and the ionization region defines a first path, a straight line extending between the electron multiplier and the ionization region defines a second path, and the second path is perpendicular to the first path.

16. The mass spectrometer apparatus of claim 15 further comprising a straight line extending between the stop detector and the ionization region defines a third path, and the third path is perpendicular to the first path.

17. The mass spectrometer apparatus of claims 12 further comprising:

first and second electrodes adjacent the ionization region for accelerating the ions toward the stop detector.

18. The mass spectrometer apparatus, of claim 12 further comprising a conductive tube between the stop detector and ionization region.

19. The mass spectrometer apparatus of claim 12 further comprising a non-conductive tube between the stop detector and ionization region.

20. The mass spectrometer apparatus of claim 12 further comprising:

an energy source coupled to the electron multiplier, the energy source for activating the electron multiplier.

21. The mass spectrometer apparatus of claim 12, further comprising:

a focussing electrode positioned between the electron multiplier and the ionization region, the focussing electrode for constraining the electron avalanche.

22. The mass spectrometer apparatus of claim 12 wherein the ionization region, the electron multiplier, and the start detector are collinear.

23. A method of analyzing a sample, comprising the steps of:

enclosing an electron multiplier in a low pressure enclosure including an ionization region;

triggering the electron multiplier to produce an electron avalanche directed into the ionization region;

generating a start signal in response to producing the electron avalanche;

directing the sample through a sample inlet into the ionization region;

colliding the electron avalanche with the sample to form ions;

accelerating the ions toward a stop detector; and generating a stop signal in response to ions interacting with the stop detector.

24. The method of claim 23 further comprising the step of calculating ion times of flight with timing electronics.

* * * * *